US010769976B2

(12) United States Patent
Cheng et al.

(10) Patent No.: US 10,769,976 B2
(45) Date of Patent: Sep. 8, 2020

(54) DISPLAY DEVICE, PIXEL CORRECTION CIRCUIT AND PIXEL CORRECTION METHOD

(71) Applicant: BOE TECHNOLOGY GROUP CO., LTD., Beijing (CN)

(72) Inventors: Chihjen Cheng, Beijing (CN); Wei Liu, Beijing (CN); Pengpeng Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 91 days.

(21) Appl. No.: 16/033,373

(22) Filed: Jul. 12, 2018

(65) Prior Publication Data

US 2019/0206292 A1 Jul. 4, 2019

(30) Foreign Application Priority Data

Jan. 2, 2018 (CN) ..... 2018 1 0002621

(51) Int. Cl.
*G09G 3/20* (2006.01)

(52) U.S. Cl.
CPC ..... *G09G 3/20* (2013.01); *G09G 2300/0814* (2013.01); *G09G 2300/0819* (2013.01); *G09G 2300/0833* (2013.01); *G09G 2320/029* (2013.01); *G09G 2320/0295* (2013.01); *G09G 2320/045* (2013.01); *G09G 2320/0626* (2013.01)

(58) Field of Classification Search
CPC ..... G09G 3/20; G09G 2320/029; G09G 2300/0833; G09G 2320/0626; G09G 2320/0295; G09G 2300/0814; G09G 2320/045; G09G 2300/0819
USPC ..... 345/214, 690
See application file for complete search history.

(56) References Cited

U.S. PATENT DOCUMENTS 8,922,292 B2 * 12/2014 Wang ..... H04L 25/0278 333/17.3
2015/0109490 A1 * 4/2015 Kanemitsu ..... H04N 5/3595 348/246
2017/0186373 A1 * 6/2017 Nishikawa ..... G11C 19/28
2018/0130423 A1 * 5/2018 Kim ..... G09G 3/3258

* cited by examiner

*Primary Examiner* — Calvin C Ma
(74) *Attorney, Agent, or Firm* — Westman, Champlin & Koehler, P.A.

(57) ABSTRACT

A pixel correction circuit includes a signal input circuit, a follower and a reading circuit. The signal input circuit is used to apply a first signal and a second signal to the follower in a correction mode. An input terminal of the follower is coupled to the signal input circuit. The follower is used to receive the first signal and the second signal sequentially, output a first follow-up signal dependent on the first signal, and output a second follow-up signal dependent on the second signal. The reading circuit is coupled to an output terminal of the follower, and reads the first follow-up signal and then generates a first read signal, and reads the second follow-up signal and then generates a second read signal. The reading circuit uses the first signal, the second signal, the first read signal and the second read signal to calculate a compensation gain.

17 Claims, 4 Drawing Sheets

DISPLAY DEVICE, PIXEL CORRECTION CIRCUIT AND PIXEL CORRECTION METHOD

CROSS-REFERENCE TO RELATED APPLICATION

This application is based on and claims priority of Chinese Patent Application No. 201810002621.1, filed on Jan. 2, 2018, which is incorporated herein by reference in its entirety.

TECHNICAL FIELD

The present disclosure relates to the field of display technology, and in particular to a pixel correction circuit, a display device including the pixel correction circuit, and a pixel correction method.

BACKGROUND

Some display devices in the related art use followers to output potentials, thereby reducing interference between pixels. An ideal follow-up effect of one follower is $A_v=1$. However, non-ideal characteristics of components such as problems that electronic mobility is not large enough or output impedance is not large enough, may result in poor follow-up effect, i.e., $A_v<1$, which will affects signal size.

SUMMARY

One embodiment of the present disclosure provides a pixel correction circuit including a signal input circuit, a follower and a reading circuit. The signal input circuit is used to apply a first signal and a second signal to the follower in a correction mode. An input terminal of the follower is coupled to the signal input circuit. The follower is used to receive the first signal and the second signal sequentially, output a first follow-up signal dependent on the first signal when receiving the first signal, and output a second follow-up signal dependent on the second signal when receiving the second signal. The reading circuit is coupled to an output terminal of the follower. The reading circuit reads the first follow-up signal and then generates a first read signal, and reads the second follow-up signal and then generates a second read signal. The reading circuit uses the first signal, the second signal, the first read signal and the second read signal to calculate a compensation gain, thereby enabling the reading circuit to perform compensation correction based on the compensation gain.

Optionally, the reading circuit is further configured to, obtain a first voltage difference of the first signal and the second signal; obtain a second voltage difference of the first read signal and the second read signal; and take a ratio of the first voltage difference to the second voltage difference as the compensation gain.

Optionally, the signal input circuit includes: a first signal receiving terminal configured to receive the first signal; a second signal receiving terminal configured to receive the second signal; a switching circuit; and a mode selection circuit. The switching circuit includes a first input terminal, a second input terminal and an output terminal; there is a first path defined between the first input terminal and the output terminal of the switching circuit; there is a second path between the second input terminal and the output terminal of the switching circuit; the first input terminal of the switching circuit is coupled to the first signal receiving terminal; the second input terminal of the switching circuit is coupled to the second signal receiving terminal. The mode selection circuit is coupled to the output terminal of the switching circuit; the mode selection circuit is further coupled to the input terminal of the follower; the mode selection circuit is configured to, in the correction mode, enable the switching circuit to be coupled with the follower. When the first path is switched on, the follower receives the first signal; and when the second path is switched on, the follower receives the second signal.

Optionally, the signal input circuit further includes a detection signal input terminal; the detection signal input terminal is configured to receive a detection signal; and the mode selection circuit is further coupled to the detection signal input terminal.

Optionally, the follower includes a follower transistor; a control terminal of the follower transistor is taken as the input terminal of the follower and is coupled to the signal input circuit; a first terminal of the follower transistor is coupled to a first power supply; and a second terminal of the follower transistor is taken as the output terminal of the follower and is coupled to the reading circuit.

Optionally, the reading circuit includes an amplifier; and the amplifier is coupled to the second terminal of the follower transistor.

Optionally, the second terminal of the follower transistor is a source terminal.

Optionally, the follower further includes a first transistor; a first terminal of the first transistor is coupled to the second terminal of the follower transistor; a second terminal of the first transistor is coupled to a second power supply; and a control terminal of the first transistor is coupled to a first transistor control terminal.

Optionally, the reading circuit includes an amplifier; and the amplifier is coupled to the second terminal of the follower transistor and the first terminal of the first transistor.

Optionally, the signal input circuit includes: a signal supply terminal configured to supply the first signal and the second signal in the correction mode; a control signal receiving terminal configured to receive a first control signal and a second control signal in the correction mode; and a reset transistor. A first terminal of the reset transistor is coupled to the signal supply terminal; a second terminal of the reset transistor is coupled to the input terminal of the follower; a control terminal of the reset transistor is coupled to the control signal receiving terminal. When the reset transistor is turned on under control of the first control signal, the follower receives the first signal; and when the reset transistor is turned on under control of the second control signal, the follower receives the second signal.

Optionally, the follower includes a follower transistor; a control terminal of the follower transistor is taken as the input terminal of the follower and is coupled to the second terminal of the reset transistor; a first terminal of the follower transistor is coupled to a first power supply; and a second terminal of the follower transistor is taken as the output terminal of the follower and is coupled to the reading circuit.

Optionally, the follower includes a follower transistor; a control terminal of the follower transistor is taken as the input terminal of the follower and is coupled to the signal input circuit; a first terminal of the follower transistor is coupled to a first power supply; and a second terminal of the follower transistor is taken as the output terminal of the follower and is coupled to the reading circuit.

Optionally, the reading circuit includes an amplifier; and the amplifier is coupled to the second terminal of the follower transistor.

Optionally, the second terminal of the follower transistor is a source terminal.

Optionally, the follower further includes a first transistor; a first terminal of the first transistor is coupled to the second terminal of the follower transistor; a second terminal of the first transistor is coupled to a second power supply; and a control terminal of the first transistor is coupled to a first transistor control terminal.

Optionally, the reading circuit reads row by row first follow-up signals and second follow-up signals output by followers in each row of pixels, generate corresponding first read signals and second read signals, and then use the first signals, the second signals, the first read signals and the second read signals to calculate a compensation gain of the each row.

One embodiment of the present disclosure further provides a display device including the above pixel correction circuit.

One embodiment of the present disclosure further provides a pixel correction method including: outputting, by a follower, a first follow-up signal dependent on a first signal when the follower receives the first signal; reading, by a reading circuit, the first follow-up signal and then generating a first read signal; outputting, by the follower, a second follow-up signal dependent on a second signal when the follower receives the second signal; reading, by the reading circuit, the second follow-up signal and then generating a second read signal; and calculating a compensation gain according to the first signal, the second signal, the first read signal and the second read signal, thereby enabling the reading circuit to perform compensation correction based on the compensation gain.

Optionally, the calculating a compensation gain according to the first signal, the second signal, the first read signal and the second read signal, includes: obtaining a first voltage difference of the first signal and the second signal; obtaining a second voltage difference of the first read signal and the second read signal; and taking a ratio of the first voltage difference to the second voltage difference as the compensation gain.

BRIEF DESCRIPTION OF THE DRAWINGS

A brief introduction will be given hereinafter to the accompanying drawings which will be used in the description of the embodiments in order to explain the embodiments of the present disclosure more clearly. Apparently, the drawings in the description below are merely for illustrating some embodiments of the present disclosure. Those skilled in the art may obtain other drawings according to these drawings without paying any creative labor.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise indicated. The following description of exemplary embodiments is merely used to illustrate the present disclosure and is not to be construed as limiting the present disclosure.

A pixel correction circuit, a display device including the pixel correction circuit, and a pixel correction method of some embodiments of the present disclosure are described hereinafter in conjunction with drawings.

Figure 1:
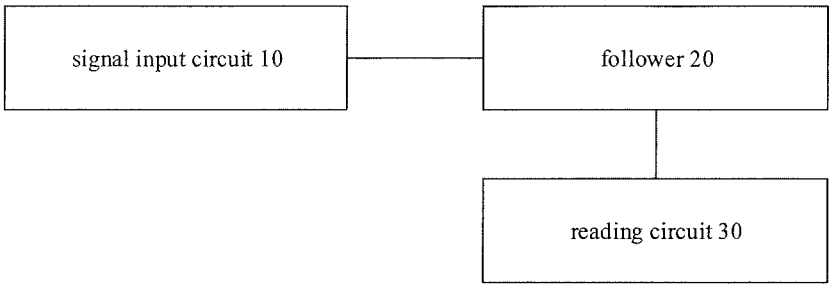
FIG. 1 shows a block diagram of a pixel correction circuit according to an embodiment of the present disclosure.

FIG. 1 shows a block diagram of a pixel correction circuit according to an embodiment of the present disclosure. As shown in FIG. 1, the pixel correction circuit includes a signal input circuit 10, a follower 20 and a reading circuit 30.

The signal input circuit 10 is configured to, in a correction mode, apply a first signal and a second signal. An input terminal of the follower 20 is coupled to the signal input circuit 10. The follower 20 is configured to receive the first signal and the second signal sequentially, output a first follow-up signal dependent on the first signal when receiving the first signal, and output a second follow-up signal dependent on the second signal when receiving the second signal. The reading circuit 30 is coupled to an output terminal of the follower 20. The reading circuit 30 reads the first follow-up signal and then generates a first read signal, and reads the second follow-up signal and then generates a second read signal. The reading circuit 30 uses the first signal, the second signal, the first read signal and the second read signal to calculate a compensation gain, thereby enabling the reading circuit 30 to perform compensation correction based on the compensation gain.

It should be noted that, the first signal and the second signal may be generated by a signal generation circuit, and the first signal and the second signal may be level signals of different voltages.

It should be noted that, an output of the follower 20 varies with an input, and the gain is proximate to 1. In other words, when the first signal is input to the input terminal of the follower 20, the output of the follower 20 is dependent on the first signal. At this point, the first follow-up signal output by the follower 20 is substantially equal to the first signal. When the second signal is input to the input terminal of the follower 20, the output of the follower 20 is dependent on the second signal. At this point, the second follow-up signal output by the follower 20 is substantially equal to the second signal.

Specifically, the output of the follower 20 may be read by the reading circuit 30. When entering in the correction mode, the signal input circuit 10 first applies the first signal, the follower 20 outputs the first follow-up signal dependent on the first signal, then the reading circuit 30 reads the first follow-up signal and generates the first read signal according to the first follow-up signal. Then, the signal input circuit 10 applies the second signal, the follower 20 outputs the second follow-up signal dependent on the second signal, then the reading circuit 30 reads the second follow-up signal and generates the second read signal according to the second follow-up signal. After generation of the first read signal and the second read signal, the reading circuit 30 uses the first signal, the second signal, the first read signal and the second read signal to calculate a compensation gain, and compensates the compensation gain back to the reading circuit 30, thereby compensating the output of the follower 20.

In this way, in the pixel correction circuit of one embodiment of the present disclosure, the signal input circuit applies the first signal and the second signal in the correction mode; the follower receives the first signal and the second signal sequentially, outputs the first follow-up signal dependent on the first signal when receiving the first signal, and outputs the second follow-up signal dependent on the second signal when receiving the second signal; the reading circuit reads the first follow-up signal and then generates the first read signal, and reads the second follow-up signal and then generates the second read signal; the reading circuit uses the first signal, the second signal, the first read signal and the second read signal to calculate a compensation gain, thereby enabling the reading circuit to perform compensation correction based on the compensation gain. As a result, the pixel correction circuit of one embodiment of the present disclosure can use the correction mechanism to solve the problem of poor follow-up effect, realize the ideal follow-up effect as much as possible and then avoid affecting signal sizes.

Specifically, according to one embodiment of the present disclosure, the reading circuit 30 is further configured to obtain a first voltage difference of the first signal and the second signal, and obtain a second voltage difference of the first read signal and the second read signal, and take a ratio of the first voltage difference to the second voltage difference as the compensation gain.

In other words, it is assumed that a voltage of the first signal is recorded as $V_{K1}$, a voltage of the second signal is recorded as $V_{K2}$, a voltage of the first read signal is recorded as $V_{01}$, a voltage of the second read signal is recorded as $V_{02}$, then the reading circuit 30 obtain a gain $(V_{O1}-V_{O2})/(V_{K1}-V_{K2})$ via calculation, and takes an inverse of the gain t as the compensation gain $A_G$, and then compensates the compensation gain back to the reading circuit 30.

After the compensation gain $A_G$ is compensated back to the reading circuit 30, the reading circuit 30 may adjust a previous gain according to the compensation gain $A_G$ and obtain an adjusted gain, and then the reading circuit 30 corrects the output signal of the follower 20 according to the adjusted gain.

Further, according to one embodiment of the present disclosure, the signal input circuit 10 is configured to apply a detection signal in a normal work mode. The follower 20 receives the detection signal and outputs a follow-up signal dependent on the detection signal. The reading circuit 30 reads the follow-up signal and then generates a corrected read signal by processing the follow-up signal according to the adjusted gain.

In other words, in the normal work mode, when the reading circuit 30 reads the follow-up signal output by the follower 20, the reading circuit 30 may process the follow-up signal according to the adjusted gain, thereby enabling the reading circuit 30 to output the corrected read signal. The corrected read signal is equivalent to a read signal output by the reading circuit 30 when the follower 20 has an ideal follow-up effect.

Figure 2:
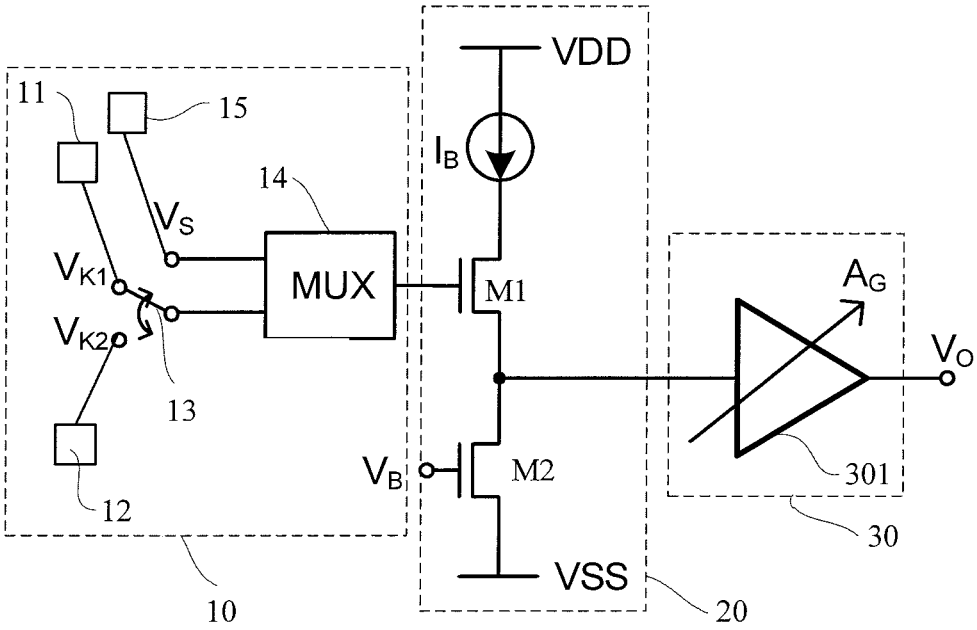
FIG. 2 is a schematic view of a pixel correction circuit according to an embodiment of the present disclosure.
Figure 3:
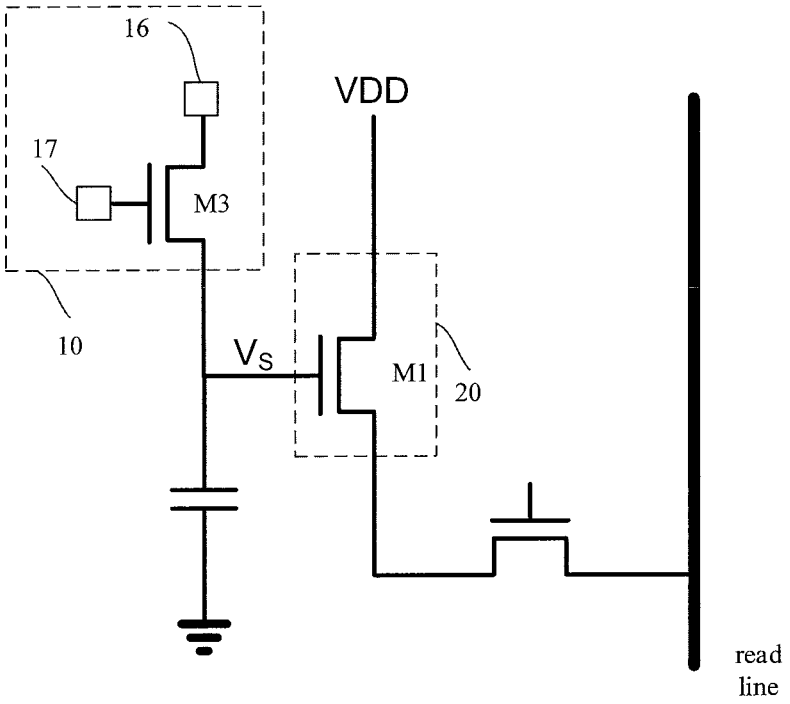
FIG. 3 is a schematic view of a pixel correction circuit according to another embodiment of the present disclosure.

According to one embodiment of the present disclosure, the follower 20 may be a source follower. Specifically, as shown in FIG. 2 and FIG. 3, the follower 20 may include a follower transistor M1. A control terminal of the follower transistor M1 is taken as the input terminal of the follower 20, and is coupled to the signal input circuit 10. A first terminal of the follower transistor M1 is coupled to a first preset power supply VDD. A second terminal of the follower transistor M1 is taken as the output terminal of the follower 20 and is coupled to the reading circuit 30. The second terminal of the follower transistor M1 may be a source terminal.

Further, as shown in FIG. 2, the follower 20 may include a first transistor M2. A first terminal of the first transistor M2 is coupled to the second terminal of the follower transistor M1. A second terminal of the first transistor M2 is coupled to a second preset power supply VSS. A control terminal of the first transistor M2 is coupled to a first transistor control terminal VB. When the follower 20 performs following output, the follower transistor M1 and the first transistor M2 may be turned on simultaneously, and a current IB flows through a circuit formed by the follower transistor M1 and the first transistor M2.

Further, according to one embodiment of the present disclosure, as shown in FIG. 2, the reading circuit 30 includes an amplifier 301. The amplifier 301 is coupled to the second terminal of the follower transistor M1. In other words, after the compensation gain $A_G$ is compensated back to the reading circuit 30, the reading circuit 30 may adjust its gain according to the compensation gain $A_G$ and obtain an adjusted gain, and then the amplifier 301 performs compensation correction for signals output from the follower 20 in a normal work mode according to the adjusted gain.

According to one embodiment of the present disclosure, as shown in FIG. 2, the signal input circuit 10 includes a first signal receiving terminal 11, a second signal receiving terminal 12, a switching circuit 13 and a mode selection circuit 14.

The first signal receiving terminal 11 is used to receive a first signal $V_{K1}$. The second signal receiving terminal 12 is used to receive a second signal $V_{K2}$. The switching circuit 13 includes a first input terminal, a second input terminal and an output terminal. There is a first path defined between the first input terminal and the output terminal of the switching circuit 13. There is a second path between the second input terminal and the output terminal of the switching circuit 13. The first input terminal of the switching circuit 13 is coupled to the first signal receiving terminal 11. The second input terminal of the switching circuit 13 is coupled to the second signal receiving terminal 12. The mode selection circuit 14 is coupled to the output terminal of the switching circuit 13. The mode selection circuit 14 is further coupled to the input terminal of the follower 20. The mode selection circuit 14 is used to, in a correction mode, enable the switching circuit 13 to be coupled with the follower 20. When the first path is switched on, the follower 20 receives the first signal. When the second path is switched on, the follower 20 receives the second signal.

As shown in FIG. 2, the signal input circuit 10 further includes a detection signal input terminal 15. The detection signal input terminal 15 is used to receive a detection signal. The mode selection circuit 14 is further coupled to the detection signal input terminal 15. The mode selection circuit 14 is used to, in a normal work mode, enable the detection signal input terminal 15 to be coupled with the follower 20, and then the follower 20 receives the detection signal.

In other words, in the correction mode, the mode selection circuit 14 enables the control terminal of the follower transistor M1 to be coupled with one of the first signal receiving terminal 11 and the second signal receiving terminal 12. For example, the switching circuit 13 may be first switched to the first signal receiving terminal 11, the first signal $V_{K1}$ is input to the follower transistor M1, then the reading circuit 30 reads the first read signal $V_{O1}$. Then the switching circuit 13 may be switched to the second signal receiving terminal 12, the second signal $V_{K2}$ is input to the follower transistor M1, then the reading circuit 30 reads the second read signal $V_{O2}$. In this way, the compensation gain can be obtained via calculation and is used to compensate the amplifier of the reading circuit 30. As a result, the problem of poor follow-up effect can be solved by performing error compensation through initial correction.

According to another embodiment of the present disclosure, as shown in FIG. 3, the signal input circuit 10 includes a signal supply terminal 16, a control signal receiving terminal 17 and a reset transistor M3.

The signal supply terminal 16 is used to, in the correction mode, supply the first signal and the second signal. The control signal receiving terminal 17 is used to, in the correction mode, receive a first control signal and a second control signal. A first terminal of the reset transistor M3 is coupled to the signal supply terminal 16. A second terminal of the reset transistor M3 is coupled to the input terminal of the follower 20. A control terminal of the reset transistor M3 is coupled to the control signal receiving terminal 17. When the reset transistor M3 is turned on under control of the first control signal, the follower 20 receives the first signal. When the reset transistor M3 is turned on under control of the second control signal, the follower 20 receives the second signal.

The signal supply terminal 16 is used to, in the normal work mode, supply a reset signal. The control signal receiving terminal 17 is used to, in the normal work mode, receive a reset control signal. When the reset transistor M3 is turned on under control of the reset control signal, the input terminal of the follower 20 is reset.

In other words, the first signal $V_{K1}$ and the second signal $V_{K2}$ may be applied via the reset transistor M3. The reset transistor M3 is used for resetting in the normal work mode, and is used to receive the first signal and the second signal in the correction mode. As a result, the reset transistor M3 may be used in time-division multiplexing way, and space can be saved.

Specifically, in the correction mode, first, the first signal $V_{K1}$ is supplied by the signal supply terminal 16 to the first terminal of the reset transistor M3, and the first control signal is supplied by the control signal receiving terminal 17 to the control terminal of the reset transistor M3. At this point, the first signal $V_{K1}$ is input ti the follower transistor M1, and then the reading circuit 30 generates the first read signal $V_{O1}$. Then, the second signal $V_{K2}$ is supplied by the signal supply terminal 16 to the first terminal of the reset transistor M3, and the second control signal is supplied by the control signal receiving terminal 17 to the control terminal of the reset transistor M3. At this point, the second signal $V_{K2}$ is input to the follower transistor M1, and then the reading circuit 30 generates the second read signal $V_{O2}$. As a result, the problem of poor follow-up effect can be solved by performing error compensation through initial correction.

Figure 4:
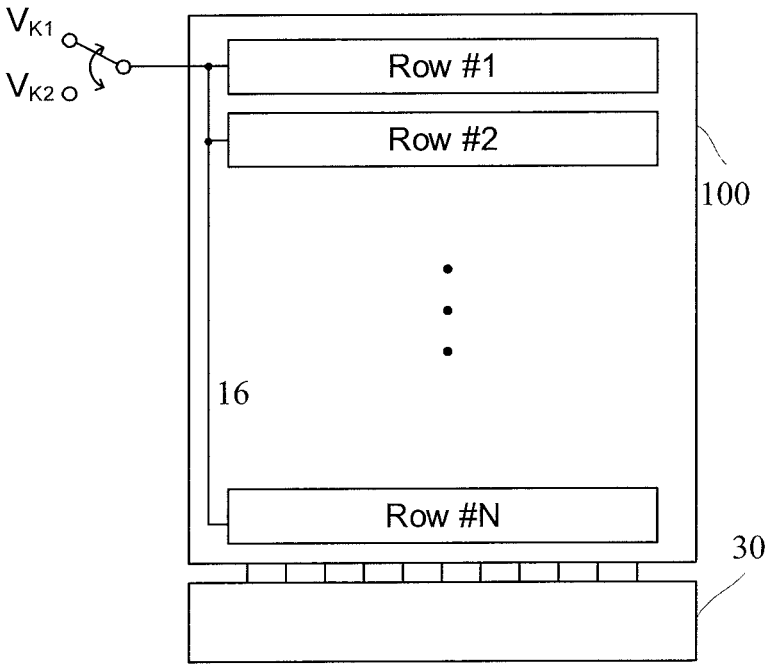
FIG. 4 is a schematic view showing that the pixel correction circuit reads pixels at an entire screen according to an embodiment of the present disclosure.

According to one embodiment of the present disclosure, as shown in FIG. 4, the reading circuit 30 may read row by row first follow-up signals and second follow-up signals output by followers in each row of pixels, generate corresponding first read signals and second read signals, and then use the first signals, the second signals, the first read signals and the second read signals to calculate a compensation gain of the each row.

Specifically, as shown in FIG. 4, a display device 100 includes N rows of pixels, including a first row Row #1, a second row Row #2, . . . and an n-th row Row # N. Each row includes a plurality of pixels. Each pixel is provided with the follower 20. In the correction mode, the reset transistors are controlled to be turned on row by row, and the first signal and the second signal may be input to the followers row by row. The reading circuit 30 may read row by row first follow-up signals and second follow-up signals output by followers in each row of pixels, and generate corresponding first read signals and second read signals. The reading circuit 30 may use the first signals, the second signals, the first read signals and the second read signals to calculate a compensation gain for the followers in each row, thereby performing compensation correction for the followers in each row.

For example, when the first signal is input to the followers in the first row Row #1, the reading circuit 30 reads first follow-up signals output by the followers in the first row Row #1 and generates corresponding first read signals. When the second signal is input to the followers in the first row Row #1, the reading circuit 30 reads second follow-up signals output by the followers in the first row Row #1 and generates corresponding second read signals. The reading circuit 30 may calculate an average voltage value of the first read signals, and calculate an average voltage value of the second read signals. Then, the reading circuit 30 may obtain a first voltage difference between the first signal and the second signal, and a second voltage difference between the average voltage value of the first read signals and the average voltage value of the second read signals, and take a ratio of the first voltage difference to the second voltage difference as a compensation gain of the first row Row #1. In this way, in the normal work mode, the reading circuit 30 may compensate output of each follower in the first row Row #1 based on the compensation gain of the first row Row #1.

When reading by taking each row as a unit, since there are a large number of pixels, the compensation correction may be performed by taking each row as a unit, thereby reducing requirement for a backend register of the reading circuit.

Of course, it should be understood that, the reading circuit 30 may read the first follow-up signal and the second follow-up signal output by the follower of each pixel, generate the corresponding first red signal and the second signal, and then use the first signal, the second signal, the first read signal and the second read signal to calculate a compensation gain for this follower. In this way, each follower may be compensated independently.

It should be noted that, the first signals and the second signals for pixel correction circuits may be generated by an identical signal input circuit 10. In other words, as shown in FIG. 4, in the correction mode, the reset transistor of each pixel in a pixel array may be coupled to the identical signal input circuit.

Figure 5:
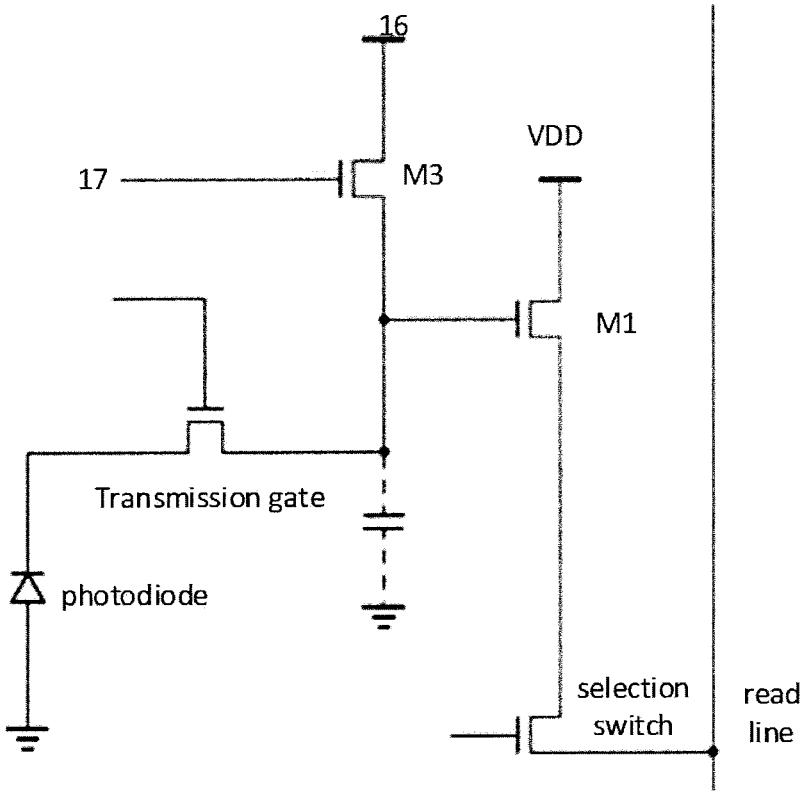
FIG. 5 is a schematic view of a pixel circuit according to an embodiment of the present disclosure.

In one embodiment of the present disclosure, the pixel correction circuit may be applied to the pixel circuit shown in FIG. 5. The pixel circuit shown in FIG. 5 is an active pixel circuit. The pixel circuit shown in FIG. 5 uses a source follower to output potentials.

Moreover, one embodiment of the present disclosure further provides a display device which includes the above pixel correction circuit.

The display device of one embodiment of the present disclosure can use the correction mechanism implemented by the above pixel correction circuit to solve the problem of poor follow-up effect, realize the ideal follow-up effect as much as possible and then avoid affecting signal sizes.

On the basis of the above pixel correction circuit, one embodiment of the present disclosure further provides a pixel correction method. The pixel correction method is corresponding to the above pixel correction circuit, thus implementation manners of the above pixel correction circuit are also suitable for the pixel correction method, and will not be elaborated herein.

Figure 6:
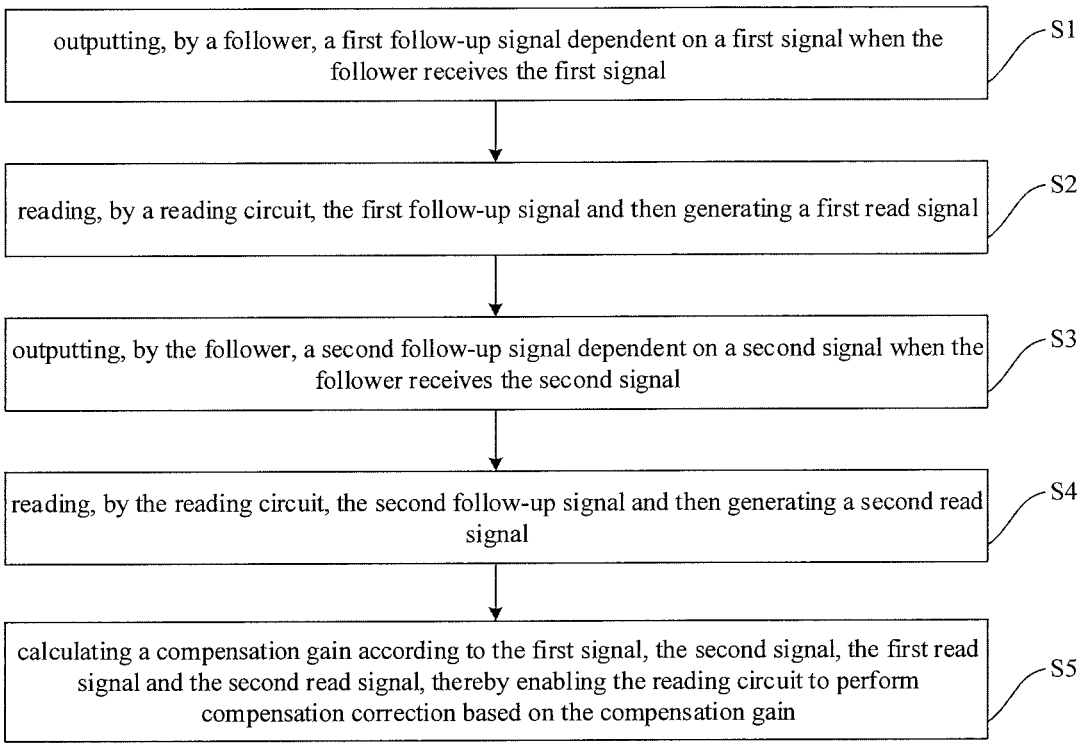
FIG. 6 is a flow chart of a pixel correction method according to an embodiment of the present disclosure.

FIG. 6 is a flow chart of a pixel correction method according to an embodiment of the present disclosure. As shown in FIG. 6, the pixel correction method includes the following steps S1 to S5.

The step S1 is to apply a first signal, and output, by a follower, a first follow-up signal dependent on the first signal when the follower receives the first signal.

The step S2 is to read, by a reading circuit, the first follow-up signal and then generating a first read signal.

The step S3 is to apply a second signal, and output, by the follower, a second follow-up signal dependent on the second signal when the follower receives the second signal.

The step S4 is to read, by the reading circuit, the second follow-up signal and then generating a second read signal.

The step S5 is to calculate, by the reading circuit, a compensation gain, according to the first signal, the second signal, the first read signal and the second read signal, thereby enabling the reading circuit to perform compensation correction based on the compensation gain.

In one embodiment of the present disclosure, calculating, by the reading circuit, a compensation gain, according to the first signal, the second signal, the first read signal and the second read signal includes: obtaining a first voltage difference of the first signal and the second signal; obtaining a second voltage difference of the first read signal and the second read signal; and taking a ratio of the first voltage difference to the second voltage difference as the compensation gain.

In the pixel correction method of one embodiment of the present disclosure, the first signal is applied, and the follower outputs the first follow-up signal dependent on the first signal when receiving the first signal; the reading circuit reads the first follow-up signal and then generates the first read signal; the second signal is applied, and the follower outputs the second follow-up signal dependent on the second signal when receiving the second signal; the reading circuit reads the second follow-up signal and then generates the second read signal; the reading circuit calculates a compensation gain according to the first signal, the second signal, the first read signal and the second read signal, thereby enabling the reading circuit to perform compensation correction based on the compensation gain. As a result, the pixel correction method of one embodiment of the present disclosure can use the correction mechanism to solve the problem of poor follow-up effect, realize the ideal follow-up effect as much as possible and then avoid affecting signal sizes.

Unless otherwise defined, any technical or scientific terms used herein shall have the common meaning understood by a person of ordinary skills. Such words as "first" and "second" used in the specification and claims are merely used to differentiate different components rather than to represent any order, number or importance. Similarly, such words as "one" or "one of" are merely used to represent the existence of at least one member, rather than to limit the number thereof. Such words as "connect" or "connected to" may include electrical connection, direct or indirect, rather than being limited to physical or mechanical connection. Such words as "on/above", "under/below", "left" and "right" are merely used to represent relative position relationship, and when an absolute position of an object is changed, the relative position relationship will be changed too.

The above are merely the preferred embodiments of the present disclosure and shall not be used to limit the scope of the present disclosure. It should be noted that, a person skilled in the art may make improvements and modifications without departing from the principle of the present disclosure, and these improvements and modifications shall also fall within the scope of the present disclosure.

What is claimed is:

1. A pixel correction circuit comprising:

a signal input circuit;

a follower; and a reading circuit;

wherein the signal input circuit is configured to apply a first signal and a second signal to the follower in a correction mode;

wherein an input terminal of the follower is coupled to the signal input circuit; the follower is configured to receive the first signal and the second signal sequentially, output a first follow-up signal dependent on the first signal when receiving the first signal, and output a second follow-up signal dependent on the second signal when receiving the second signal;

wherein the reading circuit is coupled to an output terminal of the follower, the reading circuit reads the first follow-up signal and then generates a first read signal, and reads the second follow-up signal and then generates a second read signal; and wherein the reading circuit uses the first signal, the second signal, the first read signal and the second read signal to calculate a compensation gain, thereby enabling the reading circuit to perform compensation correction based on the compensation gain, wherein the reading circuit is further configured to, obtain a first voltage difference of the first signal and the second signal; obtain a second voltage difference of the first read signal and the second read signal; and take a ratio of the first voltage difference to the second voltage difference as the compensation gain.

2. The pixel correction circuit of claim 1, wherein the signal input circuit includes:

a signal supply terminal configured to supply the first signal and the second signal in the correction mode;

a control signal receiving terminal configured to receive a first control signal and a second control signal in the correction mode; and a reset transistor;

wherein a first terminal of the reset transistor is coupled to the signal supply terminal; a second terminal of the reset transistor is coupled to the input terminal of the follower; a control terminal of the reset transistor is coupled to the control signal receiving terminal; and wherein when the reset transistor is turned on under control of the first control signal, the follower receives the first signal; and when the reset transistor is turned on under control of the second control signal, the follower receives the second signal.

3. The pixel correction circuit of claim 2, wherein the follower includes a follower transistor; a control terminal of the follower transistor is taken as the input terminal of the follower and is coupled to the second terminal of the reset transistor a first terminal of the follower transistor is coupled to a first power supply; and a second terminal of the follower transistor is taken as the output terminal of the follower and is coupled to the reading circuit.

4. The pixel correction circuit of claim 1, wherein the follower includes a follower transistor, a control terminal of the follower transistor is taken as the input terminal of the follower and is coupled to the signal input circuit; a first terminal of the follower transistor is coupled to a first power supply; and a second terminal of the follower transistor is taken as the output terminal of the follower and is coupled to the reading circuit.

5. The pixel correction circuit of claim 4, wherein the reading circuit includes an amplifier and the amplifier is coupled to the second terminal of the follower transistor.

6. The pixel correction circuit of claim 4, wherein the second terminal of the follower transistor is a source terminal.

7. The pixel correction circuit of claim 4, wherein the follower further includes a first transistor a first terminal of the first transistor is coupled to the second terminal of the follower transistor a second terminal of the first transistor is coupled to a second power supply; and a control terminal of the first transistor is coupled to a first transistor control terminal.

8. The pixel correction circuit of claim 1, wherein the reading circuit reads row by row first follow-up signals and second follow-up signals output by followers in each row of pixels, generate corresponding first read signals and second read signals, and then use the first signals, the second signals, the first read signals and the second read signals to calculate a compensation gain of the each row.

9. A display device comprising the pixel correction circuit of claim 1.

10. A pixel correction circuit comprising:

a signal input circuit;

a follower; and a reading circuit;

wherein the signal input circuit is configured to apply a first signal and a second signal to the follower in a correction mode;

wherein an input terminal of the follower is coupled to the signal input circuit; the follower is configured to receive the first signal and the second signal sequentially, output a first follow-up signal dependent on the first signal when receiving the first signal, and output a second follow-up signal dependent on the second signal when receiving the second signal;

wherein the reading circuit is coupled to an output terminal of the follower; the reading circuit reads the first follow-up signal and then generates a first read signal, and reads the second follow-up signal and then generates a second read signal; and wherein the reading circuit uses the first signal, the second signal, the first read signal and the second read signal to calculate a compensation gain, thereby enabling the reading circuit to perform compensation correction based on the compensation gain, wherein the signal input circuit includes:

a first signal receiving terminal configured to receive the first signal;

a second signal receiving terminal configured to receive the second signal;

a switching circuit; and a mode selection circuit;

wherein the switching circuit includes a first input terminal, a second input terminal and an output terminal; a first path is defined between the first input terminal and the output terminal of the switching circuit; a second path is defined between the second input terminal and the output terminal of the switching circuit; the first input terminal of the switching circuit is coupled to the first signal receiving terminal; the second input terminal of the switching circuit is coupled to the second signal receiving terminal;

wherein the mode selection circuit is coupled to the output terminal of the switching circuit; the mode selection circuit is further coupled to the input terminal of the follower; the mode selection circuit is configured to enable the switching circuit to be coupled with the follower in the correction mode; and wherein when the first path is switched on, the follower receives the first signal; and when the second path is switched on, the follower receives the second signal.

11. The pixel correction circuit of claim 10, wherein the signal input circuit further includes a detection signal input terminal; the detection signal input terminal is configured to receive a detection signal; and the mode selection circuit is further coupled to the detection signal input terminal.

12. The pixel correction circuit of claim 10, wherein the follower includes a follower transistor; a control terminal of the follower transistor is taken as the input terminal of the follower and is coupled to the signal input circuit; a first terminal of the follower transistor is coupled to a first power supply; and a second terminal of the follower transistor is taken as the output terminal of the follower and is coupled to the reading circuit.

13. The pixel correction circuit of claim 12, wherein the reading circuit includes an amplifier; and the amplifier is coupled to the second terminal of the follower transistor.

14. The pixel correction circuit of claim 12, wherein the second terminal of the follower transistor is a source terminal.

15. The pixel correction circuit of claim 12, wherein the follower further includes a first transistor; a first terminal of the first transistor is coupled to the second terminal of the follower transistor; a second terminal of the first transistor is coupled to a second power supply; and a control terminal of the first transistor is coupled to a first transistor control terminal.

16. The pixel correction circuit of claim 15, wherein the reading circuit includes an amplifier, and the amplifier is coupled to the second terminal of the follower transistor and the first terminal of the first transistor.

17. A pixel correction method comprising:

outputting, by a follower, a first follow-up signal dependent on a first signal when the follower receives the first signal;

reading, by a reading circuit, the first follow-up signal and then generating a first read signal;

outputting, by the follower, a second follow-up signal dependent on a second signal when the follower receives the second signal;

reading, by the reading circuit, the second follow-up signal and then generating a second read signal; and calculating a compensation gain according to the first signal, the second signal, the first read signal and the second read signal, thereby enabling the reading circuit to perform compensation correction based on the compensation gain, wherein the calculating a compensation gain according to the first signal, the second signal, the first read signal and the second read signal, includes:

obtaining a first voltage difference of the first signal and the second signal;

obtaining a second voltage difference of the first read signal and the second read signal; and taking a ratio of the first voltage difference to the second voltage difference as the compensation gain.

* * * * *